US010269215B2

(12) United States Patent
Prabhu

(10) Patent No.: US 10,269,215 B2
(45) Date of Patent: Apr. 23, 2019

(54) SLOT MACHINE WITH RANDOMLY VALUED SCATTER SYMBOL

(71) Applicant: Ainsworth Game Technology Limited, Newington (AU)

(72) Inventor: Sujay Prabhu, Newington (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 596 days.

(21) Appl. No.: 14/939,074

(22) Filed: Nov. 12, 2015

(65) Prior Publication Data

US 2017/0124805 A1 May 4, 2017

(30) Foreign Application Priority Data

Oct. 30, 2015 (AU) ..... 2015249185

(51) Int. Cl.
*G07F 17/32* (2006.01)
*G07F 17/34* (2006.01)

(52) U.S. Cl.
CPC ..... *G07F 17/3255* (2013.01); *G07F 17/3267* (2013.01); *G07F 17/34* (2013.01)

(58) Field of Classification Search
CPC ..... G07F 17/34; G07F 17/3213
See application file for complete search history.

(56) References Cited

U.S. PATENT DOCUMENTS 6,749,504 B2 6/2004 Hughs-Baird
2003/0060251 A1* 3/2003 Baerlocher ..... G07F 17/3244 463/12
2006/0142077 A1* 6/2006 Miles ..... G07F 17/32 463/20
2007/0155474 A1* 7/2007 Gauselmann ..... G07F 17/32 463/20
2009/0239615 A1* 9/2009 Yoshizawa ..... G07F 17/34 463/20
2010/0279760 A1* 11/2010 Sugiyama ..... G07F 17/3267 463/20
2011/0117992 A1 5/2011 Nelson et al.
2012/0077587 A1* 3/2012 Apirian ..... G07F 17/3276 463/31
2012/0231869 A1* 9/2012 Englman ..... G07F 17/3244 463/20
2013/0237306 A1* 9/2013 Meyer ..... G07F 17/3211 463/20
2013/0274011 A1* 10/2013 Meyer ..... G07F 17/3267 463/31
2013/0344939 A1* 12/2013 Aoki ..... G07F 17/326 463/21
2014/0094291 A1* 4/2014 Olive ..... G07F 17/3258 463/26

(Continued)

*Primary Examiner* — Lawrence S Galka
(74) *Attorney, Agent, or Firm* — Cook Alex Ltd.

(57) ABSTRACT

The present invention provides an electronic gaming machine comprising a display for displaying a game. The game comprises game symbols and predetermined winning combinations of randomly selected game symbols award prizes to a player. An electronic game controller controls the display of the game symbols on the display. In response to a trigger event, a prize value for a bonus prize symbol is randomly determined and the player is awarded a bonus prize based on the prize value and the number of the bonus prize symbols that are displayed in the game.

14 Claims, 8 Drawing Sheets

(56) References Cited

U.S. PATENT DOCUMENTS

| | | | | |
|---|---|---|---|---|
| 2014/0274285 | A1* | 9/2014 | Meyer | G07F 17/34 463/20 |
| 2014/0302909 | A1* | 10/2014 | Meyer | G07F 17/34 463/20 |
| 2015/0332544 | A1* | 11/2015 | Kitamura | G07F 17/34 463/20 |
| 2016/0071374 | A1* | 3/2016 | Kitamura | G07F 17/3267 463/20 |

* cited by examiner

SLOT MACHINE WITH RANDOMLY VALUED SCATTER SYMBOL

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may also be provided by an electronic gaming machine in addition to a base or main game. Typically feature games use the same set of reels as the main game and are limited to a set of free games operated under a single set of rules. This means that the feature game is restricted by the same set of rules, and so there is no variation in the play of the feature game.

Also, electronic gaming machines can offer one or more bonus prizes to the player during play of the game. The most common type of bonus prize that is awarded by the electronic gaming machine is a jackpot prize, the main example of which is a progressive jackpot prize.

This standard structure to game play and bonus prizes limits the variation in the play of the electronic gaming machine. Consequently, it is difficult to retain player interest because there is no apparent incentive for the player to continue playing the same electronic gaming machine once the player becomes familiar with the feature game, the main game and any bonus prizes. Also, it is difficult to retain player interest since there is little differentiation between gaming machines in terms of the main and feature games that are played.

This problem is exacerbated when more than one game is offered to play on the same electronic gaming machine. The option to play different games on a single machine is attractive to the player as there is no need to keep switching machines to play a different game. While this introduces some variation in game play due to different games being provided on the electronic gaming machine, the bonus prizes are often the same across the offered games.

It is an object of the present invention to overcome or substantially ameliorate one or more of the disadvantages of prior art, or at least to provide a useful alternative.

SUMMARY

According to a first aspect of the invention, there is provided an electronic gaming machine comprising:

a display for displaying a game, wherein said game comprises game symbols and predetermined winning combinations of randomly selected game symbols award prizes to a player; and an electronic game controller for controlling the display of said game symbols on the display;

wherein, in response to a trigger event, a prize value for a bonus prize symbol is randomly determined and said player is awarded a bonus prize based on said prize value and the number of said bonus prize symbols that are displayed in said game.

Preferably, said trigger event comprises an in-game trigger event. More preferably, said trigger event comprises the appearance of one or more special game symbols. In one embodiment, said special game symbols change to said bonus prize symbols in response to said trigger event. In another embodiment, said trigger event comprises a randomly determined event by said electronic game controller.

Preferably, said bonus prize is awarded after a predetermined number of plays of said game and said number of bonus prize symbols is calculated from the total number of bonus prize symbols displayed in said predetermined number of plays. That is, the number of bonus prize symbols displayed in each play of said predetermined number of plays are added to calculate said number of bonus prize symbols for determining said bonus prize awarded to said player.

Preferably, said bonus prize is calculated by multiplying said prize value by the number of said bonus prize symbols displayed in said game.

Preferably, said random determination of said prize value is shown on said display. More preferably, said prize value is randomly determined by randomly selecting a bonus prize symbol from a plurality of said bonus prize symbols representing different prize values. In some embodiments, there is a reel comprising one or more predetermined game positions, said reel displaying said plurality of said bonus prize symbols, wherein said reel is rotated and said prize value is randomly determined by randomly selecting one of said bonus prize symbols displayed in one of said game positions. In other embodiments, said bonus prize symbols comprise at least one of credit symbols, monetary symbols and jackpot symbols.

Alternatively, there is a reel comprising one or more predetermined game positions, said reel displaying indicia representing said prize values for said bonus prize symbol, wherein said reel is rotated and said prize value is determined by randomly selecting one of said indicia displayed in one of said game positions. In one embodiment, said indicia comprise at least one of credit amounts, monetary amounts and jackpots.

Preferably, at least one of said bonus prize symbols is associated with a game enhancing symbol that confers a game enhancing element to said player. More preferably, said game enhancing symbol is visibly displayed with said at least one bonus prize symbol. In one embodiment, said game enhancing symbol is displayed adjacent to said at least one bonus prize symbol. In another embodiment, said game enhancing symbol is displayed adjacent to said at least one bonus prize symbol in the same game position.

It is further preferred that said game enhancing element modifies the result of a play of said game. In one embodiment, said game enhancing element comprises the award of one or more plays of said game that do not require a bet from said player. In other words, the game enhancing element awards a predetermined number of "free" games. In some embodiments, said game enhancing element comprises at least one or more a win multiplier, wild multipliers, bonus wilds, symbols that cause the award of additional free games, trigger symbols to retrigger said at least two second arrays, held columns, random wild symbols, stacked symbols, bonus symbols, new game symbols, reveal symbols, progressives, bonus credits, jackpot symbols, and one or more symbol replacements.

Preferably, a threshold number of bonus prize symbols results in the award of a bonus prize of higher worth. In one embodiment, said threshold number of bonus prize symbols is 14 and said bonus prize of higher worth comprises a maxi jackpot. In another embodiment, said threshold number of bonus prize symbols is 15 and said bonus prize of higher worth comprises a major jackpot. In some embodiments, said game comprises an array of predetermined game positions that display said game symbols and said threshold number of bonus prize symbols comprises a majority of the number of said game positions in said array. For example, where the array is an industry standard 5×3 array, the threshold number may be from 9 up to 14 game positions in the 15 game position array. In other embodiments, said game comprises an array of predetermined game positions that display said game symbols and said threshold number of bonus prize symbols is equal to the number of said game positions in said array. In the case of an industry standard 5×3 array, the threshold number would be 15, corresponding to all of the game positions in the 15 game position array.

Preferably, said bonus prize comprises a jackpot. More preferably, said jackpot comprises a mystery jackpot which is associated with at least one of a start amount, increment amount and threshold 'win before' amount. Alternatively, said jackpot comprises a standalone progressive jackpot. In a further alternative, said jackpot comprises a linked progressive jackpot associated with a linked jackpot controller. In yet another alternative, said jackpot comprises a symbol driven jackpot associated with a trigger combination of game symbols appearing in said game.

Preferably, said bonus prize comprises a monetary amount. Alternatively, said bonus prize comprises a credit amount.

Preferably, said game comprises a base game and/or a feature game. Where said game comprises a base game and a feature game, it is preferred that said game symbols in said feature game and said base game are arranged in arrays of predetermined game or symbol positions, said arrays being the same in size, dimensions, shape and/or type. Alternatively, said game symbols in said feature game and said base game are arranged in arrays that are different in size, dimensions, shape and/or type. More preferably, a feature game array is greater in size than a base game array. In one embodiment, said base array comprises three rows and five columns and said feature game array comprises either more than three rows or more than five columns. In a further embodiment, said feature game array is an extended base game array.

Preferably, a feature game trigger event occurs in said base game to trigger said feature game. In one embodiment, said feature game trigger event comprises a random event determined by said electronic game controller at the start of play of said feature game. In another embodiment, the feature game trigger event comprises the appearance of at least one trigger symbol in said base game array. In another alternative, the feature game trigger event comprises an in-game event during play of the base game.

Preferably, said array (including the base game array and/or the feature game array) takes any one of a circular, triangular, oval, semi-circular, hexagonal, pentagonal, octagonal, non-rectangular or polygonal shape.

Preferably, in response to a feature game trigger event in said base game, said electronic game controller causes said display to display game symbols for playing said feature game. Alternatively, said electronic game controller causes the display of said feature game and said base game during play of said base game, said feature game being inactive until triggered. In this embodiment, the change in said feature game from being inactive to active may be indicated on the display. This indication may be visual, aural or a combination of both.

Preferably, said array comprises one or more rows and/or columns of said game positions. In one embodiment, said array comprises a plurality of reels. In another embodiment, said player selectively starts and/or stops play of said reels in said array.

Preferably, said electronic gaming machine comprises an input device for receiving commands from said player to play said game, wherein said input device comprises one or more buttons in electronic communication with said electronic game controller to transmit said player commands to said electronic game controller.

Preferably, said input device comprises one or more buttons on said housing, said buttons being in electronic communication with said electronic game controller. More preferably, said buttons are arranged on a console of said housing. Alternatively or additionally, said input device comprises a touch sensitive surface on said display for receiving commands from said player, said touch sensitive surface being in electronic communication with said electronic game controller to transmit said player commands to said electronic game controller.

Preferably, said electronic gaming machine comprises a value transfer mechanism for receiving value from said player to make a bet and initiate a play of said game. More preferably, said value transfer mechanism also pays said prizes to said player using value in an amount equal to an awarded prize. It is further preferred that said housing comprises said value transfer mechanism. In one embodiment, said value transfer mechanism comprises one or more vending slots for paying and/or receiving value. In other embodiments, said value transfer mechanism comprises a value input/value output device. In further embodiments, said value transfer mechanism comprises a coin slot or acceptor, a paper currency acceptor, a ticket reader and/or printer or a card reader and/or writer.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

According to a second aspect of the invention, there is provided an electronic gaming machine comprising:

a display for displaying a game, wherein said game comprises game symbols and predetermined winning combinations of randomly selected game symbols award prizes to a player;

an electronic game controller for controlling the display of said game symbols on the display; and a value transfer mechanism for receiving value from said player to initiate a play of said game;

wherein, in response to a trigger event, a prize value for a bonus prize symbol is randomly determined and said player is awarded a bonus prize based on said prize value and the number of said bonus prize symbols that are displayed in said game.

This second aspect of the invention also may have the preferred features of the first aspect of the invention stated above, where applicable.

According to a third aspect of the invention, there is provided a gaming method for an electronic gaming machine comprising a display and an electronic game controller, the method comprising the steps of:

controllably displaying game symbols for playing a game, wherein said game comprises game symbols and predetermined winning combinations of randomly selected game symbols award prizes to a player;

in response to a trigger event, randomly determining a prize value for a bonus prize symbol; and awarding a bonus prize to said player, wherein said bonus prize is based on based on said prize value and the number of said bonus prize symbols that are displayed in said game.

Preferably, said trigger event comprises the appearance of one or more special game symbols. More preferably, said method comprises changing said special game symbols into said bonus prize symbols in response to said trigger event.

Preferably, said method comprises awarding said bonus prize after a predetermined number of plays of said game and calculating said number of bonus prize symbols from the total number of bonus prize symbols displayed in said predetermined number of plays.

Preferably, said method comprises calculating said bonus prize by multiplying said prize value by the number of said bonus prize symbols displayed in said game.

Preferably, said method comprises showing said random determination of said prize value on said display. More preferably, said method comprises randomly selecting said prize value from a plurality of bonus prize symbols representing different prize values. In some embodiments, said method comprises displaying a reel comprising one or more predetermined game positions on said display, wherein said reel displays said plurality of said bonus prize symbols, rotating said reel and randomly selecting said one of said bonus prize symbols displayed in one of said game positions to determine said prize value Alternatively, said method comprises displaying a reel comprising one or more predetermined game positions on said display, wherein said reel displays indicia representing prize values for said bonus prize symbol, rotating said reel and randomly selecting said indicia displayed in one of said game positions to determine said prize value.

Preferably, said method comprises associating at least one of said bonus prize symbols with a game enhancing symbol that confers a game enhancing element to said player. More preferably, said method comprises visibly displaying said game enhancing symbol with said at least one bonus prize symbol. In one embodiment, said method comprises displaying said game enhancing symbol adjacent to said at least one bonus prize symbol. In another embodiment, said method comprises displaying said game enhancing symbol adjacent to said at least one bonus prize symbol in the same game position.

It is further preferred that said method comprises said game enhancing element awarding one or more plays of said game that do not require a bet from said player.

Preferably, said method comprises awarding a bonus prize of higher worth for a threshold number of bonus prize symbols. In one embodiment, said threshold number of bonus prize symbols is 14 and said bonus prize of higher worth comprises a maxi jackpot. In another embodiment, said threshold number of bonus prize symbols is 15 and said bonus prize of higher worth comprises a major jackpot. In some embodiments, said game comprises an array of predetermined game positions that display said game symbols and said method comprises providing said threshold number as a majority of the number of said game positions in said array. In other embodiments, said method comprises providing said threshold number equal to the number of said game positions in said array.

Preferably, said method comprises providing said bonus prize as a jackpot. Various embodiments of said jackpot are described above in relation to the first aspect of the invention.

The method may have the preferred features of the first aspect of the invention where applicable.

A fourth aspect of the present invention provides a gaming method for an electronic gaming machine comprising a display for displaying a game; an electronic game controller for controlling the display of said game symbols for playing said game on said display; and a value transfer mechanism for receiving value from said player to initiate a play of said game, the method comprising:

controllably displaying said game symbols for playing said game, wherein said game comprises game symbols and predetermined winning combinations of randomly selected game symbols award prizes to a player;

in response to a trigger event, randomly determining a prize value for a bonus prize symbol; and awarding a bonus prize to said player, wherein said bonus prize is based on based on said prize value and the number of said bonus prize symbols that are displayed in said game.

The method of the fourth aspect of the invention may have the preferred features of the third aspect of the invention stated above, where applicable.

According to a fifth aspect of the invention, there is provided a computer system comprising a central processing unit configured for communication with an electronic gaming machine, wherein said computer system is configured to perform the method of the third or fourth aspects of the invention.

According to a sixth aspect of the invention, there is provided a computer programme configured to perform the method of the third or fourth aspects of the invention.

According to a seventh aspect of the invention, there is provided a non-transitory carrier medium carrying computer executable code that, when executed on a central processing unit configured for communication with an electronic gaming machine, causes the central processing unit to perform the method of the third or fourth aspects of the invention.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

DETAILED DESCRIPTION OF VARIOUS EMBODIMENTS

Figure 1:
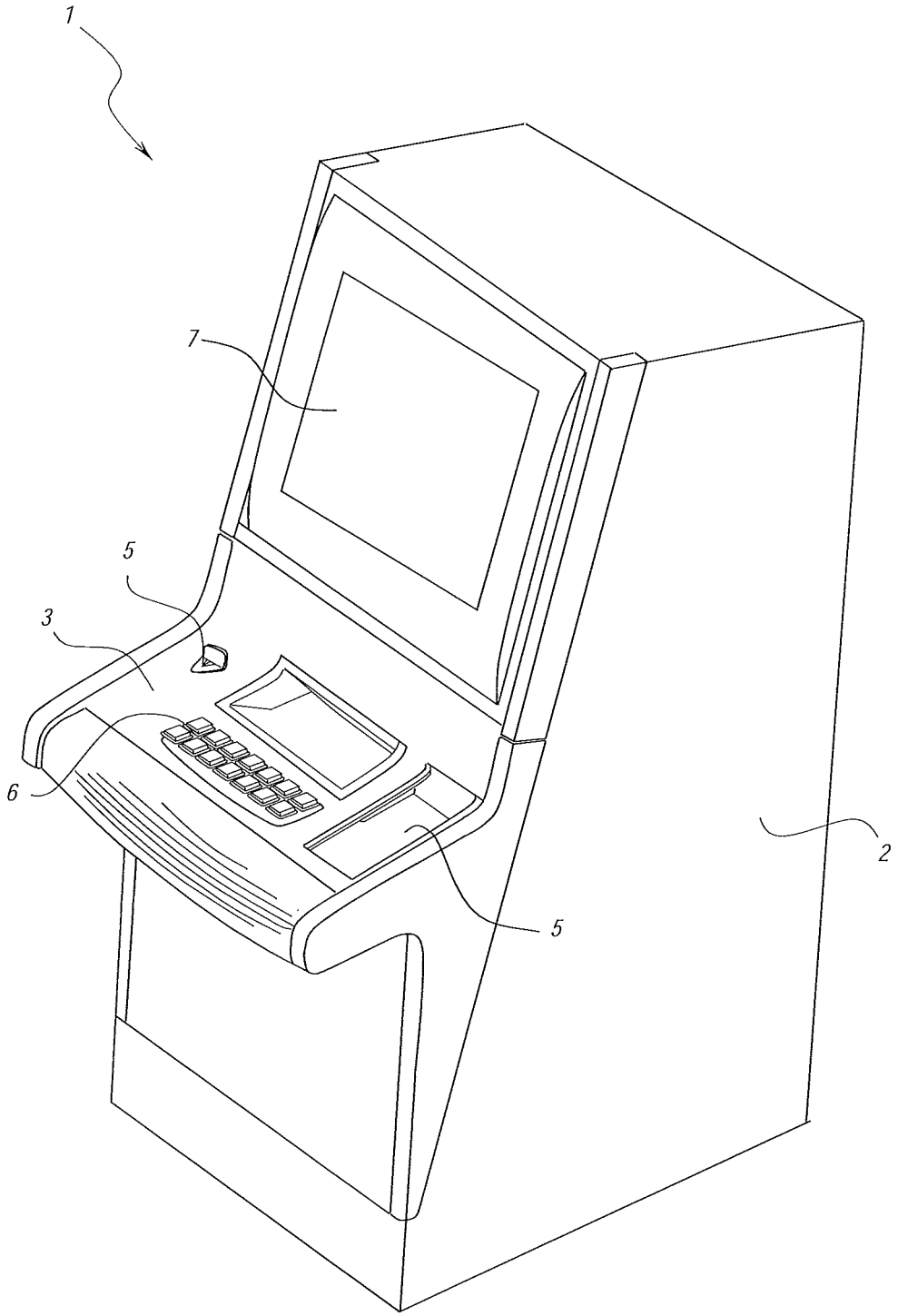
FIG. 1 is a perspective view of an electronic gaming machine according to an embodiment of the invention.

The present invention will now be described with reference to the following examples which should be considered in all respects as illustrative and non-restrictive. In the Figures, corresponding features within the same embodiment or common to different embodiments have been given the same reference numerals.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the electronic gaming machine 1. Other forms of value include gaming tokens, paper, tickets, vouchers, and any other object representative of value.

Figure 2:
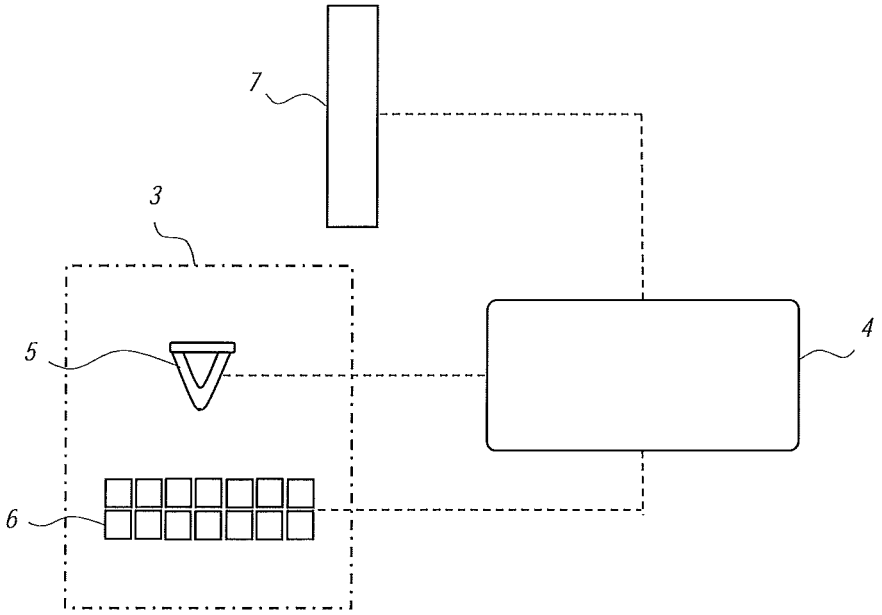
FIG. 2 is a schematic drawing of an electronic game controller for the electronic gaming machine of FIG. 1.

The electronic game controller 4 is generally in the form of a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the electronic gaming machine 1. The RAM contains a body of program instructions for implementing a game on the electronic gaming machine 1, as discussed in more detail below. The central processing unit or processor may also be operatively associated with a further storage device, such as a hard disk drive, which is used for long-term storage of program components and data relating to the electronic game controller 4 and/or the electronic gaming machine 1, including a database for game performance data, as well as information gathered from users. It is also appreciated that a person skilled in the art would readily understand the location and use of the electronic game controller 4 in the electronic gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the electronic gaming machine 1. If not, the electronic game controller 4 will send a signal to the display 7 to show a message requesting further value to be added to the electronic gaming machine 1.

Figure 3:
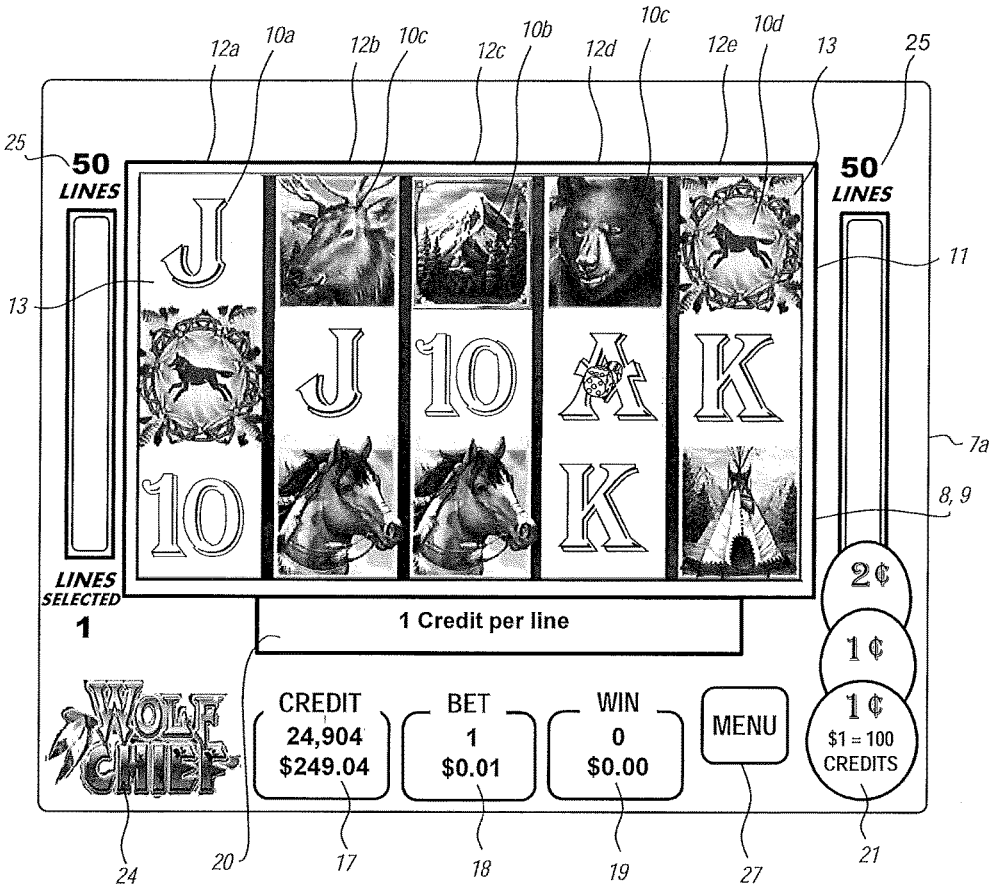
FIG. 3 is a simulated screen shot illustrating a game played on the electronic gaming machine of FIG. 1.

The electronic game controller 4 is programmed to provide a game in the form of a base game 8 (as best shown in FIG. 3) and a feature game 9 (now shown) on a lower playing area 7*a* of the display 7 of the electronic gaming machine 1 for play by a player. The base game 8 has game symbols 10 arranged into an array 11 in the form of five columns or "reels" 12. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined game or symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares" or game positions) or other markings to define each respective area of the symbol positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols. Those skilled in the art will readily understand that a substitute symbol is able to act as any other game symbol, and hence is also known as a "wild card" or "wild" symbol. Likewise, those skilled in the art will readily understand that a scatter symbol is a symbol that triggers a game event or confers an award without having to appear on a player-selected pay line 14. Similarly, a trigger symbol is a symbol that triggers a game event (like activating a feature game) or confers an award, where the trigger symbol may or may not have to appear in combination and may or may not have to appear on the same player-selected pay line 14. In this embodiment, the game symbols 10 include playing card symbols 10*a*, item-themed symbols 10*b*, animal-themed symbols 10*c*, substitute or wild card symbols in the form of wolf image symbol 10*d* and a scatter symbol in the form of a horse symbol 10*e*. The electronic game controller 4 randomly determines the appearance of the game symbols 10 on the array 11.

The lower playing area 7*a* of the video screen 7 also displays other standard game information including the amount of player credits 17, the amount of the current bet wagered by the player 18, the amount of wins by the player 19, a message area 20, a current denomination button 21 indicating the currently selected base bet denomination, the name 24 of the game "Wolf Chief" being played. Other standard information includes the number of pay lines available 25, the number of player-selected pay lines 26 and a menu button for bringing up a menu screen 27 (typically explaining the game rules and showing the available pay lines 14).

In the base game 8, the player initially makes a bet using vending slots 5 to initiate play of the electronic gaming machine 1 by building up credit to play the base game 8 on the electronic gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, electronic gaming machines offer a number of preset bet options that the player can make, and these bet options can vary depending on the game or games offered on the electronic gaming machine. For example, a game on an electronic gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

The electronic gaming machine 1 also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the electronic gaming machine has not yet been played or has been started up, the default bet denomination is initially selected by the electronic game controller 4. The default bet denomination can be randomly selected or chosen according to a predetermined order. Usually, the electronic game controller 4 will select the lowest bet denomination that is available for the base game 8, which would be the 1¢ bet denomination for this embodiment. The player may change the bet denomination at any time in the base game 8 by touching the denomination button 21 before or after the reels 12 have spun. In this embodiment, touching the denomination button 21 will bring denomination images 28, 29 that the player may select to quickly change the bet denomination between plays of the game 8.

The video display screen 7 may also include an upper display area, either as a separate display or integrated into the display screen 7, which provides jackpot information relating to available jackpots or bonus prizes in the game 8. In this embodiment, there are tiered jackpots of increasing worth, comprising a Minor jackpot, a Mini jackpot and a Major jackpot. The upper display area ensures that the jackpot information is available to the player at all times during play of the electronic gaming machine 1.

Once the player has commenced play of the game 8 by making an appropriate bet, the electronic game controller 4 then transmits a signal to the display 7 to make reels 12 to appear to visibly rotate or "spin" in a linear path, typically in a downward vertical direction, and randomly display the game symbols 10 in each symbol position 13 for each play of the array 11 for the base game 8. After the reels 12 stop spinning, the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 9 can also be provided. If so, the gaming machine 1 enters a winning game state and awards a prize according to the displayed predetermined winning combination.

The electronic game controller 4 also determines whether the feature game 9 should be activated, based on a predetermined trigger event, such as the appearance of three scatter symbols 10*e* appearing in a play or spin of the base game 8. The scatter symbols 10*e* need not appear on the same pay line 14, but can appear on any of the player-selected pay lines.

The electronic game controller 4 then transmits a signal to the video screen 7 to cause the feature game 9 to appear on the video screen 7. The feature game 9 also uses the same game symbols 10 as the base game 8, as well as the same array 11, reels 12*a* to 12*e*, symbol positions 13 and player-selectable pay lines 14 on the video screen 7. As such, the feature game 9 appears visually the same as the base game 8, and so is also effectively illustrated by FIG. 3. In the feature game 9, ten free plays or spins of the feature game are awarded to the player without having to make an additional bet or wager. It will be understood by those skilled in the art that a free play or spin involves a play of the game without requiring any bet to be made by the player, and that any number of free spins can be chosen for the feature game. In addition, it will be appreciated that in the art free plays or spins are commonly referred to as "free games". The number of free games remaining in the feature game 9 may be indicated by a counter shown near the array 11 on the screen 7. Typically, the prizes awarded for the same winning combinations of game symbols in the feature game 9 are of higher worth than the prizes awarded in the base game 8.

Figure 4:
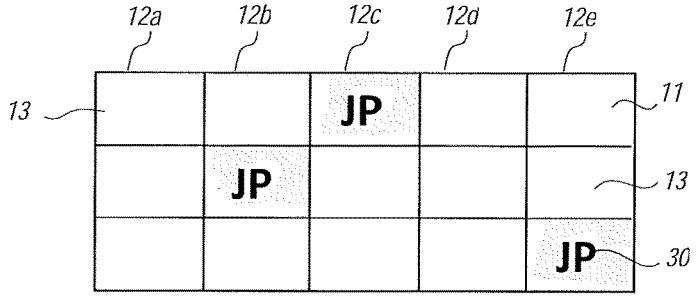
FIG. 4 is a schematic drawing illustrating the display of special game symbols in the game of FIG. 3.
Figure 5:
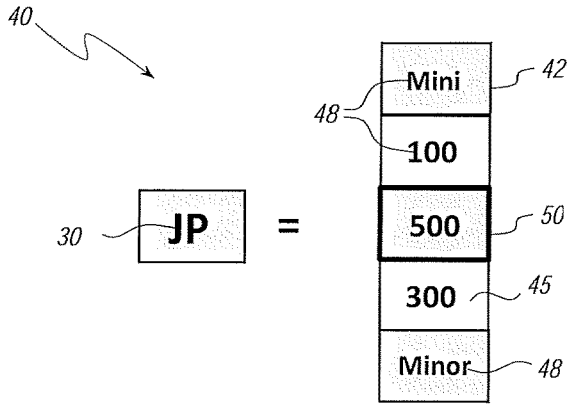
FIG. 5 is a schematic drawing illustrating the selection of a prize value for the bonus prize symbol in the game of FIG. 3.

Also, in the base game 8 there is a special game symbol in the form of a jackpot scatter symbol 30, as best shown in FIG. 4. The jackpot scatter symbol 30 also acts as a substitute or wild card symbol in the base game 8. In the embodiment, the appearance of at least three jackpot scatter symbol 30 triggers a special bonus prize award or jackpot feature game 40 to be shown on the display screen 7. This jackpot feature game 40 is provided on the electronic gaming machine 1 in addition to the standard feature game 9. Alternatively, the jackpot feature game 40 is part of the base game 8 and/or feature game 9. In the jackpot feature game 40, a reel 42 is displayed over the array 11 and rotates to determine a prize value, as best shown in FIG. 5. In other embodiments, the reel 42 may be located adjacent to the array 11 so as to not obscure the reels 12*a* to 12*e*.

The reel 42 has a plurality of game or symbol positions 45 that each display a variety of bonus prize symbols 48 representing different prize values and an indicator 50 for indicating the prize value selected (and hence, bonus prize symbol 48) that will be substituted for the jackpot scatter symbol 30. In this embodiment, the indicator 50 is a highlighted central game position in the reel 40 adjacent to an image of the jackpot scatter symbol 30 and an "equals" sign 52. In other embodiments, the indicator may take the form of a pointer, arrow or other visual sign to indicate the selected bonus prize symbol 48 for the jackpot scatter symbol 30.

Figure 6:
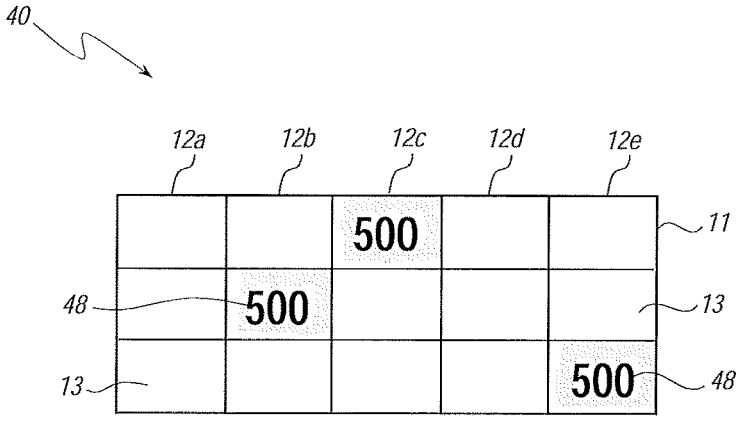
FIG. 6 is a schematic drawing illustrating the display of bonus prize symbols in the game of FIG. 3.

In FIG. 5, the bonus prize symbol 48 randomly selected by the reel 40 is "500". As a result, the jackpot scatter symbols 30 immediately change into the 500 bonus prize symbol 48, as best shown in FIG. 6. A similar result would occur where the bonus prize symbol 48 randomly selected by the reel 40 was "100", "300", "Mini" or "Minor". In other embodiments, the jackpot scatter symbols 30 are not changed into the randomly selected bonus prize symbol 48, but instead the selected bonus prize symbol is randomly displayed in several game positions 13 on the array 11, with the number of game positions being the same as or even exceeding the number of initially displayed jackpot scatter symbols 30.

The reels 12*a* to 12*e* are then spun ten times to see whether any additional bonus prize symbols 48 appear on the reels. These spins are "free" spins similar to the free games awarded in the feature game 9. In some embodiments, the reels 12*a* to 12*e* can be spun any number of predetermined times and the predetermined number of times could be determined by the amount of the bet made by the player. In other embodiments, there are no free spins and the bonus prize symbols 48 only replace any jackpot scatter symbols 30 appearing on the reels 12*a* to 12*e* (which must be at least the minimum number to activate the jackpot feature game 40).

Once the bonus prize symbol 48 appears in a game position 13 on the reels, the bonus prize symbols 48 remain in their respective game positions 13. In this way, the number of bonus prize symbols 48 that accumulate during the spins can be readily determined. This means that the maximum number of bonus prize symbols 48 is equal to the number of game positions 13 in the array 11. In some embodiments, the bonus prize symbols 48 are not held in place in the game positions 13, but instead the reels 12*a* to 12*e* are fully spun. This enables more bonus prize symbols 48 to appear in excess of the number of game positions 13.

Figure 7:
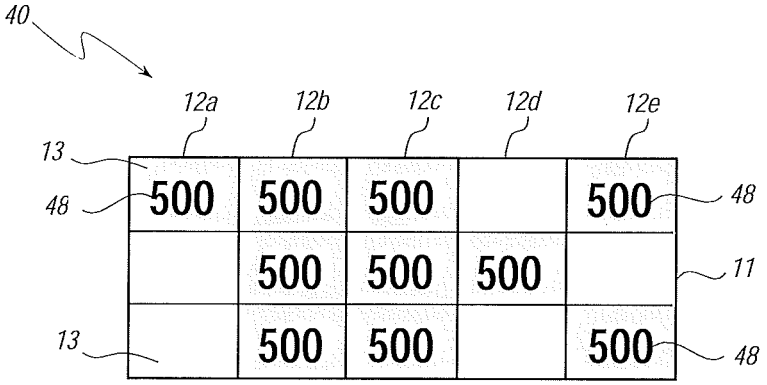
FIG. 7 is a schematic drawing illustrating awarding of a bonus prize in the game of FIG. 3.

Once the final spin is completed, the bonus prize is awarded to the player and is calculated based on the prize value associated with the bonus prize symbol 48 and the number of bonus prize symbols that have been accumulated or collected over the ten free spins of the jackpot feature game 40. As best shown in FIG. 7, an example of the end of the jackpot feature game 40 is illustrated, where at the conclusion of the ten free spins, the player has accumulated ten "500" bonus prize symbols 48 (this includes the initial three jackpot scatter symbols 30 that changed into bonus prize symbols 48 at the start of the free spins). Hence, the player is awarded a bonus prize or jackpot of 5,000 credits which is calculated from the prize value of the bonus prize symbol 48, being 500 credits, multiplied by the number of bonus prize symbols 48 that have been accumulated, being ten of these symbols. Where the bonus prize symbol 48 is "Mini" or "Minor" the jackpot is calculated based on the current worth of the Mini or Minor jackpot shown in the upper display area 7*b* of the screen 7 multiplied by the number of Mini or Minor bonus prize symbols 48 that have been accumulated by the player over the ten free spins.

It will be appreciated that in other embodiments, the random selection of the bonus prize symbol 48 (or selection of a prize value for the bonus prize symbol) can be shown in ways other than using the reel 40, such as having a pointer or arrows randomly move over displayed prize values and/or bonus prize symbols and randomly stopping to indicate the selected prize value/bonus prize symbol. In one embodiment, an animated spotlight moves over the array 11 and stops at the game position 13 showing the jackpot scatter symbol 30, which then displays the randomly selected bonus prize symbol 48 or prize value.

Moreover, the reel 40 need not have a plurality of game positions 45 but comprise only one game position in which the bonus prize symbols 48 are randomly displayed and selection occurs when the random display stops on one of the bonus prize symbols. In addition, the bonus prize symbols 48 may be numerical amounts equal to the prize value for the bonus prize symbol or other symbols that indicate the prize value selected for the bonus prize symbol.

Figure 8:
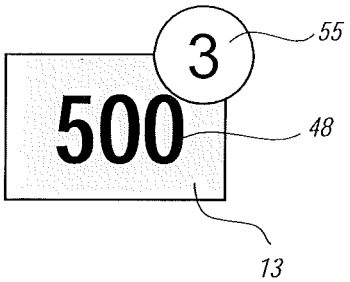
FIG. 8 is a schematic drawing illustrating another embodiment of the bonus prize symbol for the game of FIG. 3.

In a further embodiment illustrated in FIG. 8, a game enhancing symbol 55 is associated with the bonus prize symbol 48 that confers a game enhancing element to the player. In this embodiment, the game enhancing symbol 55 is a small circle with the number "3" shown adjacent to the bonus prize symbol 48 and provides an additional three free spins of the jackpot feature game 40. This increases the chances of the player accumulating more bonus prize symbols 48 and hence a greater amount for the jackpot awarded. In other embodiments, the game enhancing symbol 55 can provide other game enhancing elements that modify the result of a play of a game. For example, the game enhancing symbol 55 can be a multiplier that multiplies the amount of the jackpot. In this case, the jackpot would be tripled with the "3" game enhancing symbol 55 shown in FIG. 8.

In addition, the game enhancing symbol 55 can be shown adjacent the bonus prize symbol 48 in the same game position 13 instead of overlapping the game position 13 as shown in FIG. 8. Also, the game enhancing symbol 55 may appear elsewhere on the screen 7 to indicate its association with the bonus prize symbol 48. A line could be drawn between the game enhancing symbol 55 and the bonus prize symbol 48, for example, to indicate the association.

A variety of game enhancing elements can be awarded by the game enhancing symbols 55, including:

- symbols that award a predetermined number of free plays of said game;
- win multiplier symbols that multiply the amount of any win from one of said predetermined winning combinations;
- "wild" symbols that cause the display of substitute symbols in randomly selected symbol positions;
- bonus symbols that awards a bonus prize, either as a monetary amount or as a bonus credit;
- wild multiplier symbols that cause the display of substitute symbols on the array 11 and multiplies the amount of any win from one of said predetermined winning combinations;
- bonus wild symbols that cause the display of substitute symbols on the array 11 and awards a bonus prize;
- symbols that cause the award of additional free plays of said game;
- symbols that cause one or more of said symbol positions to be held static (typically one or more reels 12*a* to 12*e*) and display substitute symbols on the array 11;
- symbols that cause the same game symbol to be stacked in a group of symbol positions, typically the group being one or more reels 12*a* to 12*e;*
- symbols that cause the display of new game symbols on the array 11;
- "reveal" symbols that cause a game symbol to reveal another game symbol; and
- "replacement" symbols that cause one or more game symbols to be replaced by other game symbols in the array 11.

These game enhancing symbols do not modify the function or value of the game symbols 10 that appear on the arrays 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the game enhancing symbols may indicate the duration in which its game enhancing element is applied, such as a predetermined number of spins or a predetermined time period.

In yet another embodiment, the jackpot awarded is enhanced where a threshold number of bonus prize symbols 48 are accumulated by the player. For example, in a 5×3 array a "maxi" jackpot is awarded where bonus prize symbols 48 appear in fourteen of the fifteen game positions 13 in the array 11. Likewise, a "major" jackpot is awarded where bonus prize symbols 48 appear in all fifteen game positions 13 of the array 11. In some embodiments, the threshold number is a predetermined number of game positions 13 in the array 11, and preferably comprises a majority of the game positions.

Figure 9:
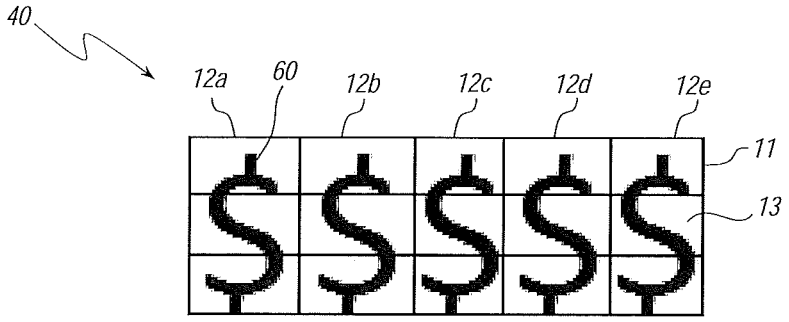
FIG. 9 is a schematic drawing illustrating a further embodiment of the bonus prize symbol for the game of FIG. 3.
Figure 10:
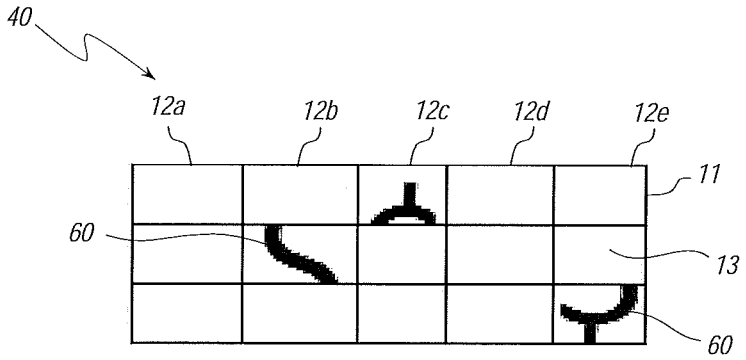
FIG. 10 is a schematic drawing illustrating the display of the bonus prize symbol of FIG. 9.

In a further embodiment, the bonus prize symbols 48 collectively form a picture, image or message on the array 11, with each bonus prize symbol 48 comprising a "jigsaw" puzzle piece to complete the picture, image or message that covers all the game positions 13 on the array 11. As best shown in FIG. 9, the bonus prize symbols 60 of this embodiment collectively create an image or picture showing dollar signs in each reel 12*a* to 12*e*. Hence, when the jackpot feature game 40 begins, for example with the jackpot scatter symbols 30 shown in FIG. 4, the bonus prize symbols 60 are shown in the same game positions 13. In this way, the player is encouraged to complete the jigsaw puzzle during the jackpot feature game 40 and thus win a jackpot of higher worth. In this embodiment, the bonus prize symbols 60 forming the jigsaw puzzle pieces have the same prize value so that completing the jigsaw in the ten free games of the jackpot feature game 40 will award the player the maximum prize value for the jackpot. In other embodiments, the bonus prize symbols 60 have different prize values depending on their location (game position 13) in the array 11 so that bonus prize symbols 60 in certain game positions attract higher prize values. For example, the bonus prize symbols 60 appearing in the game positions 13 of reels 2 and 4 (corresponding to reels 12*b* and 12*d*) may have credit prize values of 500 while the bonus prize symbols 60 appearing in the game positions 13 of reels 1, 3 and 5 (corresponding to reels 12*a*, 12*c* and 12*e*) may have credit prize values of only 300.

Figure 11:
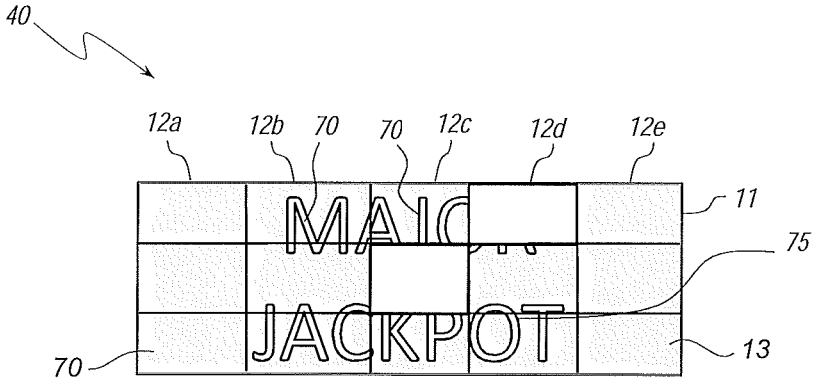
FIG. 11 is a schematic drawing illustrating yet another alternative embodiment of the bonus prize symbol for the game of FIG. 3.

A further alternative to this embodiment is illustrated in FIG. 11, where the bonus prize symbols 70 collectively form a message 75 with the words "MAJOR JACKPOT". In this case, completing the jigsaw puzzle results in the award of the major jackpot. Similarly, the message may include other jackpots, such as "GRAND JACKPOT", "MINI JACKPOT", "MAXI JACKPOT", "MIDI JACKPOT" or similar wording to indicate the type of jackpot that is won upon completing the jigsaw puzzle. The type of jackpot that can be won may be linked to the amount that the player has bet to play the base game 8 and/or total amount bet including any ante-bets or side bets. Again, this encourages players to attempt to complete the jigsaw puzzle and win the stated jackpot in the message 75.

In other embodiments, a higher worth jackpot is awarded in addition to the jackpot awarded upon completing the puzzle. For example, completing the puzzle on the array 11 may result in the award of a major jackpot and the player is further rewarded with a grand jackpot that is typically a progressive standalone jackpot. In another example, completing the puzzle on the array 11 may result in the award of the accumulated prize values (such as, 300 or 500 credits) of the bonus prize symbols 48 and a major or grand jackpot also being awarded.

The jackpots offered by the electronic gaming machine 1 through the jackpot feature game 40 are effectively symbol driven jackpots. However, in other embodiments the jackpots may be standalone progressive jackpots, fixed jackpots, mystery jackpots and any combination thereof, including symbol driven jackpots (i.e. a mixture of different types of jackpots). In some embodiments, the jackpots are limited to the jackpot feature game 40. In other embodiments, the jackpots are shared by the jackpot feature game 40, the base game 8 and/or the feature game 9. That is, the jackpots could be won through play of the base game 8 or feature game 9, although they are more likely to be won through the jackpot feature game 40.

A progressive jackpot prize takes a portion of each bet (typically a set percentage of each bet) made on the electronic gaming machine and thus the amount of the progressive jackpot incrementally increases as more bets are made on the electronic gaming machine 1. The progressive jackpot is typically awarded when a winning game combination associated with the jackpot occurs in the game played on the electronic gaming machine. In many cases, progressive jackpots are associated with the least probable winning combination and are commonly the highest paying award of the electronic gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the electronic gaming machine or the incremented amount of the progressive jackpot, a trigger event is activated in the electronic gaming machine to pay out the progressive jackpot prize. Progressive jackpot prizes also tend to be shared amongst multiple electronic gaming machines so as to increase the amount of the progressive jackpot prize and hence increase player interest in playing one of the electronic gaming machines. In some electronic gaming machines, more than one jackpot or progressive jackpot is offered by the electronic gaming machine or electronic gaming machines linked together.

The jackpot or bonus prizes may also be mystery jackpots rather than symbol driven jackpots. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the base game 8 and/or feature game 9. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the trigger event may also be used to determine whether the feature game 9 is triggered in the base game 8 or the jackpot feature game 40 is triggered in either the base game 8 or feature game 9.

Progressive jackpots can be confined to the electronic gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified electronic gaming machines that are linked together for jackpot purposes (usually via a central jackpot controller). The jackpot prizes can also be shared with any other games offered on the same electronic gaming machine 1 (as in multi-game gaming machines).

During play of the base game 8 and/or feature game 9, the electronic game controller will determine whether the trigger event for the jackpot feature game 40 (and/or a separate trigger event where the jackpot can also be won outside the jackpot feature game 40) has occurred, being the appearance of three jackpot scatter symbols 30 as described above. After the jackpot(s) are awarded upon completion of the jackpot feature game 40 or the trigger event, the amounts for any awarded jackpots are reset and the electronic gaming machine 1 returns to the base game 8 or feature game 9. The amounts of the jackpots that have been won can be reset either to a predetermined start amount or simply increment upwardly from zero where the won jackpot is a progressive jackpot.

In some embodiments, the in-game trigger event is determined at the end or during the play of the game; i.e. at the end or during a spin of the reels 12. In some embodiments, the in-game trigger event occurs in a preceding play of the game so that the result of the in-game trigger event takes place in a subsequent play of said game, typically the next play of the game after said preceding play but could include a later successive play of the game.

In other embodiments, the electronic gaming machine 1 also offers the player the opportunity to play in community games against other players in so-called tournament games, or even in player versus player games. This is typically implemented by electronically linking several electronic gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in said selected available jackpot set.

It will be appreciated that in other embodiments, game enhancing elements can also be awarded in the feature game 9 in addition to the jackpot feature game 40. The game enhancing elements may further be awarded in addition or as an alternative to the enhanced prizes awarded based on winning combinations of game symbols 10 in the feature game 9. The award of game enhancing elements can be done by way of a sixth reel or the appearance of game enhancing symbols in the reels 12*a* to 12*e*.

In some embodiments, the game enhancing symbols include "collector"-type game enhancing symbols which award points or tokens. The collection of points or tokens during the base game 8 and/or feature game 9 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

Also, the arrangement of the game 8 as shown in FIG. 3 is not limited to a set of reels or columns, but could take other forms, such as non-rectangular arrays (i.e. arrays that do not comprise rows and columns). For example, where the array is circular, the predetermined game positions can take the form of pie-shaped slices or wedges.

While the same game format is essentially used across the base game 8, feature game 9 and jackpot feature game 40, it will be appreciated that the game format may vary across these games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment of the invention has been described in relation to a base game 8 and a feature game 9, it will be appreciated that the invention could include one or more additional feature games that are triggered by specific trigger symbols appearing in the feature game 9. Also, the additional feature games may also have trigger symbols that trigger further feature games in a cascading fashion. These additional and further feature games could have the same game play elements as the feature game 9 or be different feature games entirely.

Furthermore, the embodiments of the invention have been described as providing a standard 5×3 set of reels 12 for the base game 8. However, it will be appreciated that in other embodiments, the size and shape of the reels 12 may vary. For example, the array 11 could take any number of different shapes, such as triangular, circular, square, hexagonal, hemispherical or other polygonal shapes.

In other embodiments, the base game 8 (and the feature game) need not be displayed on a single video screen 7. Instead, they may be displayed on separate video screens, with the lower playing area 7*a* appearing in a lower video screen and the upper display area 7*b* on an upper video screen. Also, the order can be reversed, with the playing area 7*a* appearing on an upper video screen or upper part of a single video display screen 7 and the display area 7*b* appearing on a lower video screen or lower part of a single video display screen.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the electronic gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

Figure 12:
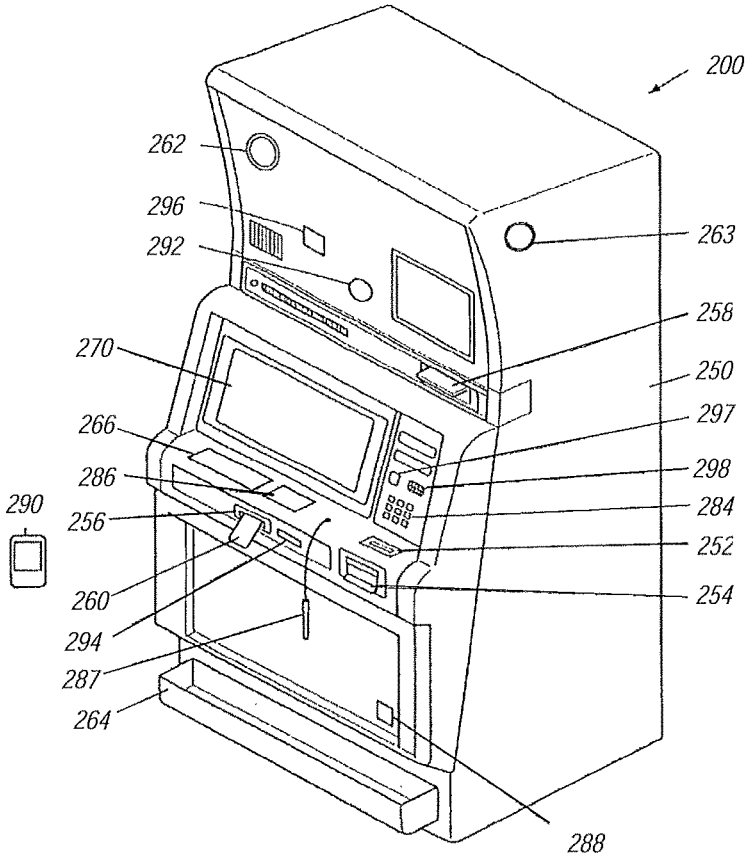
FIG. 12 is a perspective view of an electronic gaming machine according to yet another embodiment of the invention.

Referring to FIG. 12, another embodiment of the invention is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper (not shown) may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the player's gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 13:
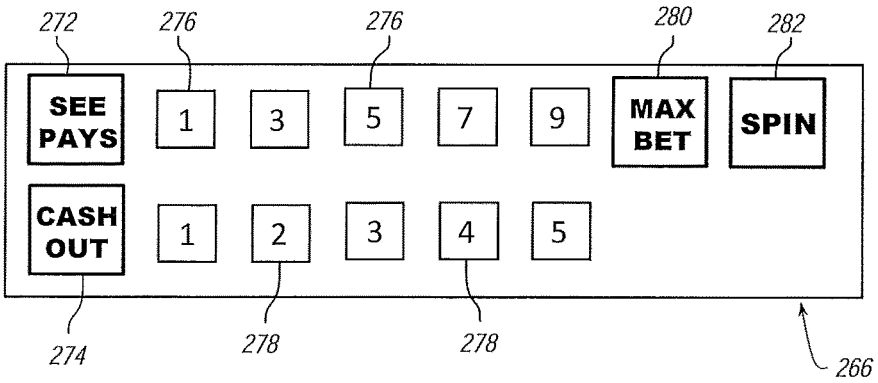
FIG. 13 is a schematic drawing of a control panel for the electronic gaming machine of FIG. 12.

FIG. 13 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 1¢, 2¢, 5¢, 10¢ and 20¢, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 20¢ could be wagered for each pay line selected, the maximum wager would be $1.80 The control panel 266 may include a spin button 282 to allow the player to initiate spinning of the reels after a bet has been made.

In FIG. 13, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 14:
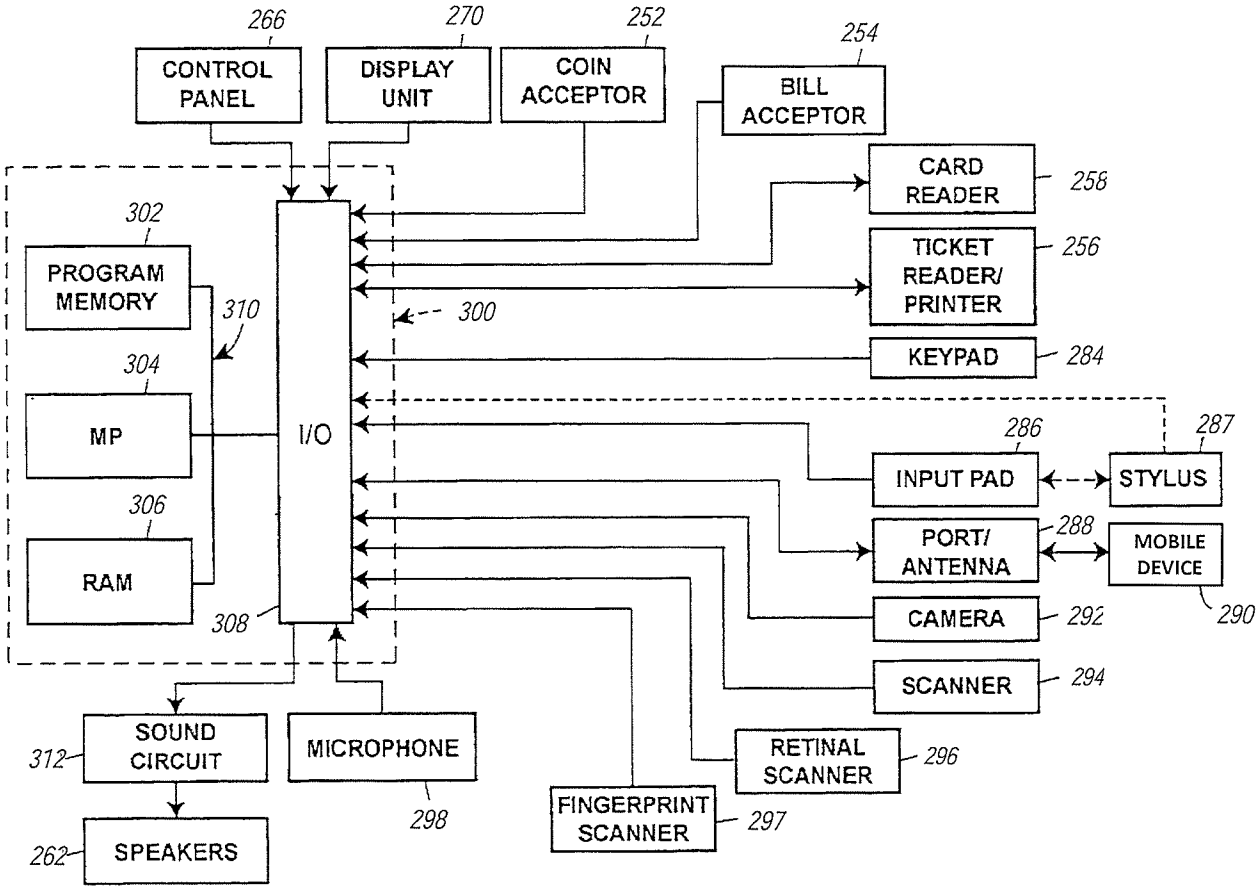
FIG. 14 is a block diagram of the electronic components of the electronic gaming machine of FIG. 12.

FIG. 14 is a block diagram of a number of components that may be incorporated in the electronic gaming machine 200. Referring to FIG. 14, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 14 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 14, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 13 may be connected to the I/O circuit 308 via a common bus or other data link that is shared by a number of components. Furthermore, some of the components may be directly connected to the microprocessor 304 without passing through the I/O circuit 308.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer programme configured to perform the invention. In this way the invention can be implemented in various ways on an electronic gaming machine. In a further aspect, the invention includes a gaming system configured comprising a central processing unit (such as a computer or computational processor) configured for communication with an electronic gaming machine to perform the invention. In a yet another aspect, the invention includes a non-transitory computer readable or carrier medium carrying computer executable code that, when executed on a central processing unit configured for communication with an electronic gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of the player being able to selectively starting or stopping spinning of the reels 12 and the feature of providing separate video screens for the lower playing area 7*a* and upper display area 7*b* can be combined into a single electronic gaming machine 1. In another example, the feature of a mystery jackpot can be readily combined with the feature of different array formats for each game 8. Similar combinations of two or more features from the above described embodiments or embodiments of the invention can be readily made by one skilled in the art.

By providing bonus prize symbols that are randomly allocated a value, the player is able to ascertain the value of any bonus prize that can be won through accumulation of bonus prize symbols during play of the electronic gaming machine. Moreover, the accumulation of bonus prize symbols heightens the player's excitement as he or she realises that a greater value for the bonus prize will be obtained as more bonus prize symbols are accumulated or collected. This increases player interest and encourages the player to continue playing the game. All these advantages of the invention result in the player being more likely to retain interest in continuing to play the same electronic gaming machine. Furthermore, since the electronic game controller controls operation of the electronic gaming machine, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine, comprising:

a display for displaying a game, wherein said game comprises game symbols and where predetermined winning combinations of randomly selected game symbols in said game award prizes to a player;

an electronic game controller for controlling the display of said game symbols on said display; and a value transfer mechanism for receiving value from said player to initiate a play of said game;

wherein, in response to a trigger event, a single prize value used for all bonus prize symbols of a plurality of bonus prize symbols displayed on said display is randomly determined and said player is awarded a bonus prize based on said prize value and the number of said bonus prize symbols that are displayed in said game, wherein said trigger event comprises the appearance of one or more special game symbols, and wherein said special game symbols change to said bonus prize symbols in response to said trigger event.

2. The electronic gaming machine of claim 1, wherein said bonus prize is calculated by multiplying said prize value by the number of said bonus prize symbols displayed in said game.

3. The electronic gaming machine of claim 1, wherein said random determination of said prize value is shown on said display.

4. An electronic gaming machine, comprising:

a display for displaying a game, wherein said game comprises game symbols and where predetermined winning combinations of randomly selected game symbols in said game award prizes to a player;

an electronic game controller for controlling the display of said game symbols on said display; and a value transfer mechanism for receiving value from said player to initiate a play of said game;

wherein, in response to a trigger event, a single prize value used for all bonus prize symbols of a plurality of bonus prize symbols displayed on said display is randomly determined and said player is awarded a bonus prize based on said prize value and the number of said bonus prize symbols that are displayed in said game, wherein said random determination of said prize value is shown on said display, and wherein said prize value is randomly determined by randomly selecting a bonus prize symbol from a plurality of said bonus prize symbols representing different prize values.

5. The electronic gaming machine of claim 4, further comprising a single reel associated with all bonus prize symbols of the plurality of bonus prize symbols, the single reel comprising one or more predetermined game positions, said single reel displaying indicia representing prize values for said bonus prize symbols, wherein said reel is rotated and said single prize value is determined by randomly selecting one of said indicia displayed in one of said game positions.

6. The electronic gaming machine of claim 5, wherein said bonus prize symbols comprise at least one of credit symbols, monetary symbols and jackpot symbols.

7. An electronic gaming machine, comprising:

a display for displaying a game, wherein said game comprises game symbols and where predetermined winning combinations of randomly selected game symbols in said game award prizes to a player;

an electronic game controller for controlling the display of said game symbols on said display; and a value transfer mechanism for receiving value from said player to initiate a play of said game;

wherein, in response to a trigger event, a single prize value used for all bonus prize symbols of a plurality of bonus prize symbols displayed on said display is randomly determined and said player is awarded a bonus prize based on said prize value and the number of said bonus prize symbols that are displayed in said game, wherein a threshold number of bonus prize symbols results in the award of a bonus prize of higher worth, and wherein said game comprises an array of predetermined game positions that display said game symbols and said threshold number of bonus prize symbols comprises at least a majority of the number of said game positions in said array.

8. The electronic gaming machine of claim 7, wherein said game comprises an array of predetermined game positions that display said game symbols and said threshold number of bonus prize symbols is equal to the number of said game positions in said array.

9. The electronic gaming machine of claim 7, wherein said bonus prize of higher worth comprises at least one of a jackpot, a standalone progressive jackpot, a linked progressive jackpot associated with a linked jackpot controller, a symbol driven jackpot associated with a trigger combination of game symbols appearing in said game, and a mystery jackpot which is associated with at least one of a start amount, increment amount and threshold 'win before' amount.

10. The electronic gaming machine of claim 7, wherein said threshold number of bonus prize symbols is 14 and said bonus prize of higher worth comprises a maxi jackpot.

11. The electronic gaming machine of claim 7, wherein said threshold number of bonus prize symbols is 15 and said bonus prize of higher worth comprises a major jackpot.

12. An electronic gaming machine, comprising:

a display for displaying a game, wherein said game comprises game symbols and where predetermined winning combinations of randomly selected game symbols in said game award prizes to a player;

an electronic game controller for controlling the display of said game symbols on said display; and a value transfer mechanism for receiving value from said player to initiate a play of said game, wherein, in response to a trigger event, a single prize value used for all bonus prize symbols of a plurality of bonus prize symbols displayed on said display is randomly determined and said player is awarded a bonus prize based on said prize value and the number of said bonus prize symbols that are displayed in said game, and wherein said bonus prize is awarded after a predetermined number of plays of said game and said number of bonus prize symbols being calculated from the total number of bonus prize symbols displayed in said predetermined number of plays.

13. The electronic gaming machine of claim 12, wherein said bonus prize is calculated by multiplying said prize value by the number of said bonus prize symbols displayed in said game.

14. The electronic gaming machine of claim 12, wherein said random determination of said prize value is shown on said display.

* * * * *